United States Patent [19]

Fedele

[11] Patent Number: 4,627,091

[45] Date of Patent: Dec. 2, 1986

[54] LOW-ENERGY-CONTENT VOICE DETECTION APPARATUS

[75] Inventor: Nicola J. Fedele, Kingston, N.J.

[73] Assignee: RCA Corporation, Princeton, N.J.

[21] Appl. No.: 481,383

[22] Filed: Apr. 1, 1983

[51] Int. Cl.[4] ..... G10L 5/00

[52] U.S. Cl. ..... 381/46; 364/900; 381/41

[58] Field of Search ..... 381/41, 42, 43, 44, 381/45, 46, 47, 48, 50, 110; 364/513, 513.5, 550, 551, 498, 900; 375/34, 76, 99; 455/212, 222, 221, 79

[56] References Cited

U.S. PATENT DOCUMENTS

| | | | |
|---|---|---|---|
| 4,057,690 | 11/1977 | Vagliani et al. | 381/46 |
| 4,084,245 | 4/1978 | Bunge | 381/42 |
| 4,158,749 | 6/1979 | Deman et al. | 381/46 |
| 4,239,936 | 12/1980 | Sakoe | 381/43 |
| 4,297,533 | 10/1981 | Gander et al. | 381/46 |
| 4,403,114 | 9/1983 | Sakoe | 381/42 |
| 4,410,763 | 10/1983 | Strawczynski et al. | 364/513.5 |
| 4,426,730 | 1/1984 | Lajotte et al. | 381/46 |
| 4,481,593 | 11/1984 | Bahler | 364/513.5 |

OTHER PUBLICATIONS

R. J. Johnson & G. F. Snyder, "Speech Detector", IBM Technical Disclosure Bulletin, vol. 22, No. 7, Dec. 1979, pp. 2624–2625.

G. D. Ewing & J. F. Taylor, "Computer Recognition of Speech Using Zero-Crossing Information", IEEE TAE, vol. AU-17, No. 1, Mar. 1969, pp. 37–40.

D. J. Comer, "The Use of Waveform Asymmetry to Identify Voiced Sounds", IEEE TAE, vol. AU-16, No. 4, Dec. 1968, pp. 500–506.

*Primary Examiner*—Gareth D. Shaw
*Assistant Examiner*—John J. Salotto
*Attorney, Agent, or Firm*—Joseph S. Tripoli; Robert L. Troike; Christopher L. Maginniss

[57] ABSTRACT

An apparatus for detecting and storing digital data corresponding to spoken words carried by acoustic signals includes apparatus for detecting and storing the unvoiced portion of speech which often precedes the voiced portion of a word, even where the amplitude of the unvoiced portion is comparable to the background noise level. The apparatus includes dynamic storage which holds data corresponding to a fixed time period prior to detection of the larger-amplitude voiced segment. Voiced speech is detected when it exceeds a stored value related to the average background noise. At the instant of this detection, the segment of prior data held in the dynamic storage is retained for analysis as unvoiced speech.

18 Claims, 4 Drawing Figures

LOW-ENERGY-CONTENT VOICE DETECTION APPARATUS

This invention relates to speech recognition systems and, more particularly, to an apparatus which detects and stores articulated sounds, including the low-energy segment which may occur at the beginning of spoken words.

It is well known that articulated sound is produced by means of a two-fold excitation mechanism of the human vocal tract. The first such excitation mechanism which is responsible for "voiced" or vocalized sounds consists of substantially periodic air impulses resulting from vibration of the vocal chords. The second such excitation mechanism is responsible for "unvoiced" or unvocalized sounds and consists of voice sources which are created from the air turbulence resulting from the narrowing of the vocal tract itself. Thus, the speech signal is substantially periodic during such "voiced" segments and is characterized by a high average energy level while, on the other hand, during such "unvoiced" segments, the speech signal is not at all periodic and is characterized by a low average energy level, it thus being apparent that the average energy level of the composite speech signal will normally vary over time. Accordingly, speech detection systems which compare the short-term average energy level of the speech signal with a single preset constant threshold level fail to detect the presence of a speech signal when its average energy level drops below that threshold level, as may occur, for example, during "unvoiced" segments.

In many speech recognition systems, characterized in that a digitally-coded form of the detected analog waveform of a spoken word or phrase is stored for processing, there is frequently a difficulty in detecting the beginning of a word. This results in the storage of less than the entire word and a consequent impediment to the recognition of the stored data as the articulated word. The difficulty of detection arises from the fact that many words begin with an unvoiced sound, e.g., a consonant sound having a very low energy content approximating that of the background noise, and this sound fails to trigger the detecting apparatus.

Techniques have been developed to extract the low-energy speech elements from a noisy background. See, for example, "Speech Detector," by R. J. Johnson and G. F. Snyder, *IBM Technical Disclosure Bulletin,* vol. 22, no. 7, December 1979, pp. 2624–25, describing a circuit which detects the presence of speech based on its greater energy variance than that of noise; and U.S. Pat. No. 4,057,690, issued Nov. 8, 1977, to Vagliani et al., in which two segments of the envelope of an input signal are compared over two different time domains to determine if a preselected magnitude of difference exists between the envelopes, thereby indicating the presence of speech information on the input signal.

Nevertheless, the problem of detecting the initiation of an unvoiced segment of a word still remains. A typical speech detection and storage system includes a sensing device, a signal converter (e.g., an A/D converter), and a memory. Additionally, because it is impractical to provide a memory having capacity sufficient to store the analog-to-digital converted output of the sensing device on a continuous basis, further means must be included to control the amount of data to be stored. The traditional approach is to introduce within the system a threshold device which rejects noise-level signals, but which causes higher energy signals, i.e., voiced speech, to be converted and stored.

The problem arises of how to determine the threshold. If set too high, only voiced speech is stored, eliminating the unvoiced segment which very often initiates a word and which frequently distinguishes one word from another. Note, for example, that initial f's, h's and p's are all very low-energy unvoiced segments; failure to store these sounds would make the words "fat," "hat," and "pat" indistinguishable. However, if the threshold is set too low, simple noise energy may trigger the system causing useless information to be saved and memory space wasted. What is required is a system which stores an entire word or phrase, including the unvoiced segments of low-energy content at the beginning of a word, but which does not store substantial portions of background noise of similar low-energy content.

In accordance with one embodiment of the present invention, an apparatus for detecting and storing digital data corresponding to spoken words carried as acoustic energy includes transducer means for transforming the acoustic energy into analog electrical signals, signal processing means for converting the analog signals to substantially equivalent forms of digital data and for sampling the digital data at a predetermined rate, and first storage means for temporarily storing samples of the digital data from the signal processing means. The apparatus further includes means for computing the average signal level of digital data samples from the signal processing means during predetermined periods of time, and means for generating a control signal when the computed average signal level exceeds a predetermined level. Finally, the apparatus includes second storage means and means responsive to the control signal for conveying digital data stored in the first storage means to the second storage means, wherein the conveyed data includes digital data stored in the first storage means prior to the generation of the control signal.

In accordance with a further embodiment of the present invention, an apparatus for detecting and storing digital data corresponding to spoken words carried as acoustic energy includes transducer means for transforming the acoustic energy into analog electrical signals, signal processing means for converting the analog signals to substantially equivalent forms of digital data and for sampling the digital data at a predetermined rate. The digital data samples are applied to a means for computing the average signal level of the samples during predetermined period of time. A storage means is provided which includes a plurality of m contiguous blocks which are consecutively and ordinally numbered first through mth. Each of the blocks comprises an equal number of storage locations, where the number of storage locations in each block is the number of samples of digital data operated upon by the means for computing average signal level during each of the predetermined periods of time. Means for generating sequential addresses corresponding to individual storage locations of the storage means enable the digital data samples to be stored therein. Finally, control means are provided which cause the following two events to occur when the average signal level computed during any of the predetermined time periods fails to exceed a predetermined level: (a) data resident in the storage locations of the second through nth blocks ($n << m$) of the storage means are transferred into corresponding locations of the first through (n−1)st blocks, respectively; and (b) the address generating means is reset such that it generates the initial storage location of the nth block.

Figure 1:
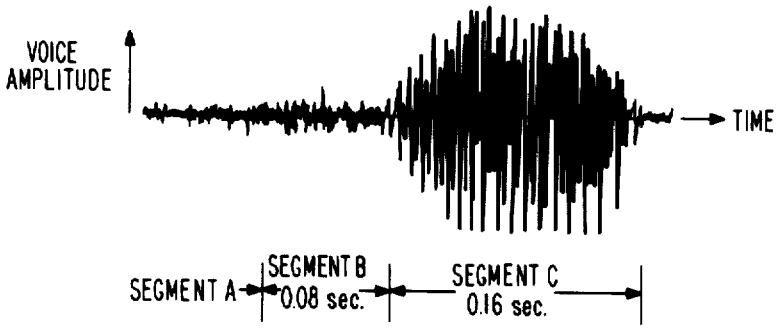
FIG. 1 is an amplitude vs. time plot of a signal representing a spoken word.

FIG. 1 depicts a diagram of a spoken word in the form of instantaneous amplitude over a period of time. It is readily understood that the amplitude of the voice signal is related to acoustic energy. The diagram, in which time proceeds toward the right, is divided into three segments. Segment A represents the period of background noise preceding the initiation of speech; segment B represents the period of the unvoiced portion of the spoken word; and segment C represents the duration of the voiced portion of the word.

As was noted in the discussion of earlier paragraphs, there is not a substantial difference between the level of the background noise, in segment A, and the unvoiced portion of the spoken word, in segment B. Obviously, a voice recognition system can trigger on the large amplitude of the voiced portion of a spoken word, as in segment C. Nevertheless, as the earlier discussion pointed out, it is very desirable that a voice recognition system include, in addition to an analysis of the waveforms of segment C, an analysis of the segment B waveforms.

The two embodiments of the present invention, which will be described in relation to the apparatus shown in FIGS. 2 and 3, include as a common principle the retention of a limited storage of sound energy which immediately precedes detection of voiced speech. Thus, when the voiced segment is detected, the data stored prior to voice detection may be analyzed to determine if it contains unvoiced speech.

Figure 2:
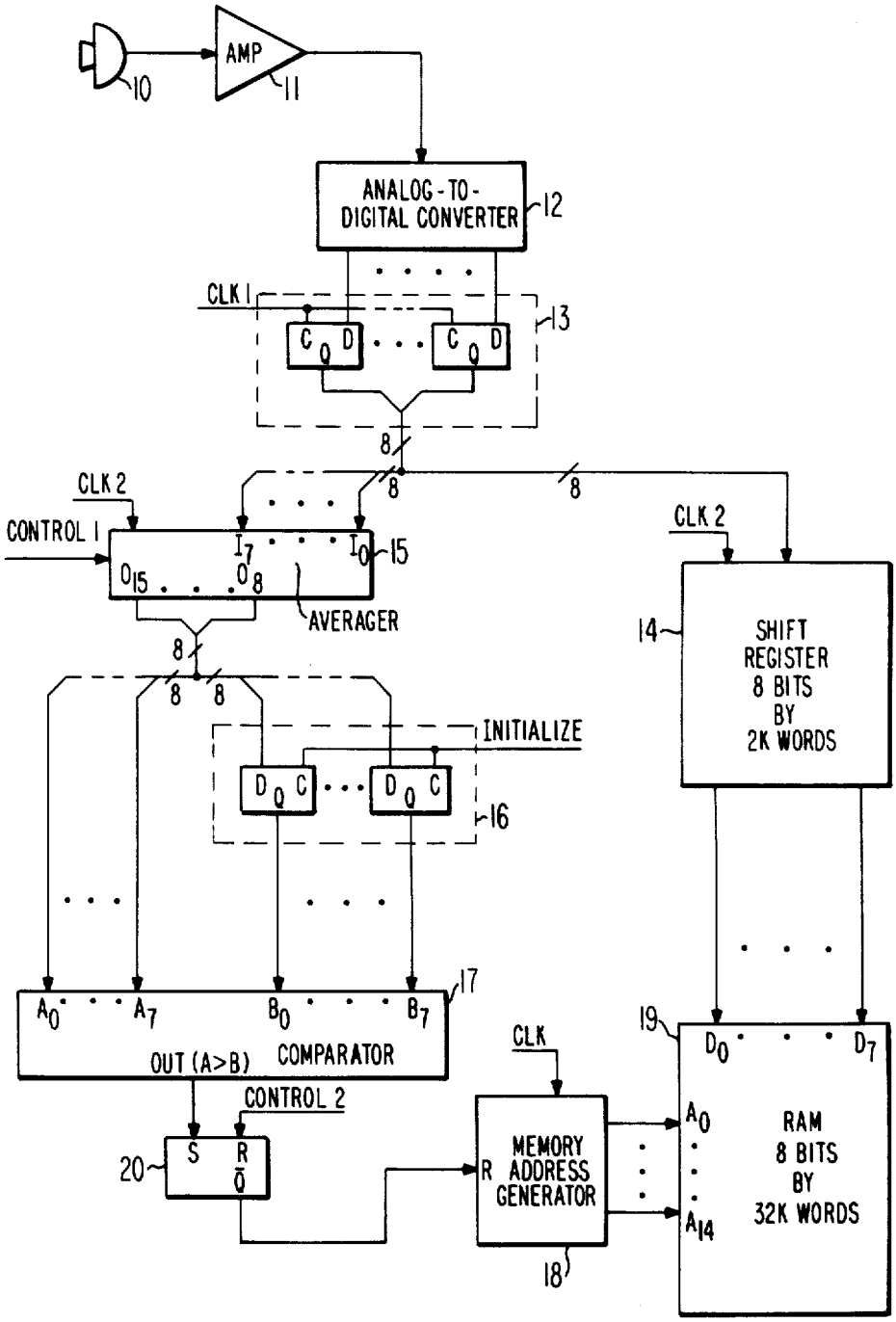
FIG. 2 illustrates, via a block diagram representation, an apparatus for detecting and storing spoken words according to a first embodiment of the present invention.

Referring to FIG. 2, a system is shown wherein audible sounds are received by sensing device 10 which is typically a microphone. The electrical signal produced as a result of the sound pressure waves at sensing device 10 is applied to amplifier 11. The analog signal output of amplifier 11 is coupled to analog-to-digital (A/D) converter 12 which generates a plurality of output signals providing a substantially equivalent digital representation of the instantaneous amplitude of the input analog signal. A/D converters are well known and are adequately described in *Analog-Digital Conversion Handbook*, Daniel H. Sheingold, ed., Analog Devices, Inc., Norwood, Mass., 1972, at pp. II-45 through -53. In the example of FIG. 2, eight digital output signals from A/D converter 12 are represented. These signals are coupled to sample-and-hold circuit 13 which stores the states of the eight digital signals at discrete periodic instances. Sample-and-hold circuit 13 may comprise, for example, eight D-type flip-flops, of a type similar to type CD40174B, sold by RCA Corporation, Somerville, N.J., having their data (D) inputs coupled individually to the eight output signals from A/D converter 12, and having their clock inputs all coupled to a single clock signal which strobes in the input data at a rate of, for example, 16 KHz.

In the embodiment of FIG. 2, the eight output signals of sample-and-hold circuit 13 are applied to the inputs of storage device 14 and to the inputs of averaging circuit 15. Storage device 14 is a first-in-first-out (FIFO) shift register having a width of eight bits, in the present example, and a selectable length, which typically may be 1024 (1K) or 2048 (2K) bits. A 1K-by-8 bits FIFO register may be fabricated from an array of static shift registers of a type similar to type CD4052A, or from an array of smaller FIFO registers of a type similar to type CD40105B, according to design procedures well known among practitioners skilled in the art. Data are clocked in and through storage device 14 on a clock phase when the data in sampling circuit 13 are stable.

Averaging circuit 15 receives the digital data samples from sampling circuit 13 and, after a predetermined period during which a fixed number of data samples have been regarded, provides, in response to a periodic control signal, an output digital signal, also of eight bits, representing the average value of the input signals during that period. The averaging method may involve a straight arithmetic mean, which is relatively simple to fashion using conventional digital logic hardware, or it may involve a more complex statistical analysis, requiring an independent data processing uint, such as a microprocessor. A typical arithmetic averaging circuit may include an adder for summing each successive sample up to a fixed number which is an integral power of two, for example, 256, with a sufficient number of overflow bits in the adder to contain the entire running sum. Since binary division is effectuated by shifting within a register, the average of the samples would be found in the higher order bits of the adder. In the present example, where data are received by input bit positions 0 through 7 of the adder, the average of 256 samples is found shifted by $\log_2 256=8$ bits, viz., in output bit positions 8 through 15. Thus, an adequate averaging circuit 15 may be fashioned in a manner well known in the art, using full adders of a type similar to type CD4008B.

The output signals from averaging circuit 15, which number eight in the present example, are coupled both to storage register 16 and to a first set of inputs to digital comparator circuit 17. Storage register 16 may be similar to sample-and-hold circuit 13; alternatively, it may comprise eight D-type latches, of a type similar to type CD4042A, rather than D-type edge-triggered flip-flops as specified for sampling circuit 13. The digital data signals from averaging circuit 15 are clocked into storage register 16 upon the control command INITIALIZE, which is to be discussed below. The eight digital data output signals of storage register 16 are coupled to a second set of inputs to digital comparator circuit 17.

Digital comparator circuit 17 compares the magnitude of the digital word comprising the eight signals from averaging circuit 15 with the digital word comprising the eight signals, similarly ordered, from storage register 16. Digital comparator circuit 17 may comprise two 4-bit magnitude comparators of a type similar to type CD4063B. Comparator circuit 17 includes an output signal which indicates that the digital word at its first set of inputs $A_0$ through $A_7$ (from averaging circuit 15) exceeds the digital word at its second set of inputs $B_0$ through $B_7$ (from storage register 16).

Storage device 19 is a random access memory (RAM) which, in the present example, includes storage locations for 32,768 (32K) words of eight bits each. Its eight data inputs are coupled to the eight outputs of shift register 14. The 32K memory words are individually accessed via 15 address lines which are driven by memory address generator 18. Memory address generator 18 may comprise, for example, a resettable 15-stage binary counter including ripple-carry counters of a type similar to type CD4040A for sequentially generating memory addresses. The output signal from digital comparator circuit 17 is coupled to the RESET input of memory address generator 18 via set-reset flip-flop 20. Flip-flop 20 is set by an occurrence of the digital comparator 17 output signal and remains set until a control signal indicates that the apparatus is primed to detect another spoken word.

The operation of the apparatus of FIG. 2 requires an antecedent initialization procedure. This procedure measures the background noise level at a time when there are no speech elements, and stores information corresponding to this measured level for subsequent comparisons when the speech detection procedure is in operation.

During initialization, background noise as received in microphone 10, amplified in amplifier 11, and converted into digital data by A/D converter 12. The digital data are periodically sampled in sampling circuit 13; the data samples are applied to averaging circuit 15, and clocked therein by the CLK2 signal. After a fixed number of samples have been received by averaging circuit 15, the INITIALIZE signal clocks averaging circuit 15 output signals into storage register 16. In this way, digital data, corresponding to an average background noise level, are stored in register 16 to function as a threshold level against which later detections of speech/noise can be measured.

As a practical matter, during speech detection operation it is required that an average speech level not merely exceed the measured average background noise, but that the average speech level exceed the background by at least a fixed amount. Hence the threshold must be an amount greater than that stored in register 16 using the above-described method. This increased threshold might be provided by an augmentation of the data in register 16 or by a modification of the criterion for the occurrence of the comparator 17 output signal. However, perhaps the most effective method, one which does not require any additional hardware, is to allow averaging circuit 15 to read in a number of samples in excess of the dividing factor, thus storing in register 16 a threshold value exceeding the average background noise level. As an example, if, during normal operation, averaging circuit 15 reads 256 values of digital data samples from sampling circuit 13 and computes an average from their sum, the initialization procedure would allow averaging circuit 15 to read 320 values of background noise samples, and compute the average based on 256 samples. Thus, the threshold value stored in register 16 would be about 25% above the average background noise level.

Once the initialization procedure is complete and register 16 contains a threshold value, the apparatus of FIG. 2 will function as a speech detection and storage device. Audible waveforms are received in microphone 10 where they are converted to analog electrical signals which are then amplified in amplifier 11 and transformed into equivalent digital signals in A/D converter 12. The digital output signals of converter 12 are periodically clocked on CLK1 into sampling circuit 13. The sampled signals are applied to the input terminals of shift register 14 and averaging circuit 15, and clocked into both on CLK2, when the sampled digital signals are stable. The signals applied to shift register 14 are clocked through and out of that device, and are applied to the input terminals of RAM 19.

Flip-flop 20 is reset by control signal CONTROL2 prior to the start of a detection operation. The signal at the $\overline{Q}$ output of flip-flop 20, applied at the reset (R) input of memory address generator 18, jams all zeroes on the address lines coupled to RAM 19. Thus, so long as flip-flop 20 is reset, the data which emerge at the output terminals of shift register 14 are effectively lost.

When comparator 17 determines that the digital data representing the average received acoustic signal level exceeds the threshold level stored in register 16, flip-flop 20 is set and address generator 18 is freed to begin counting. The data shifted out of shift register 14 now begins to be read into RAM 19, beginning with data corresponding to acoustic signals received well in advance of the setting of flip-flop 20. At the end of the operation, RAM 19 will contain, in addition to the data corresponding to the voiced speech element, a sizable portion of data corresponding to acoustic signals preceding the voiced element. This earlier data, which amounts to 1792 samples (2K less the 256 samples which were read into shift register 14 and subsequently determined by comparator 17 to have exceeded the threshold level), provides ample information for analysis to establish the identity of any unvoiced element which may have been present.

Figure 3:
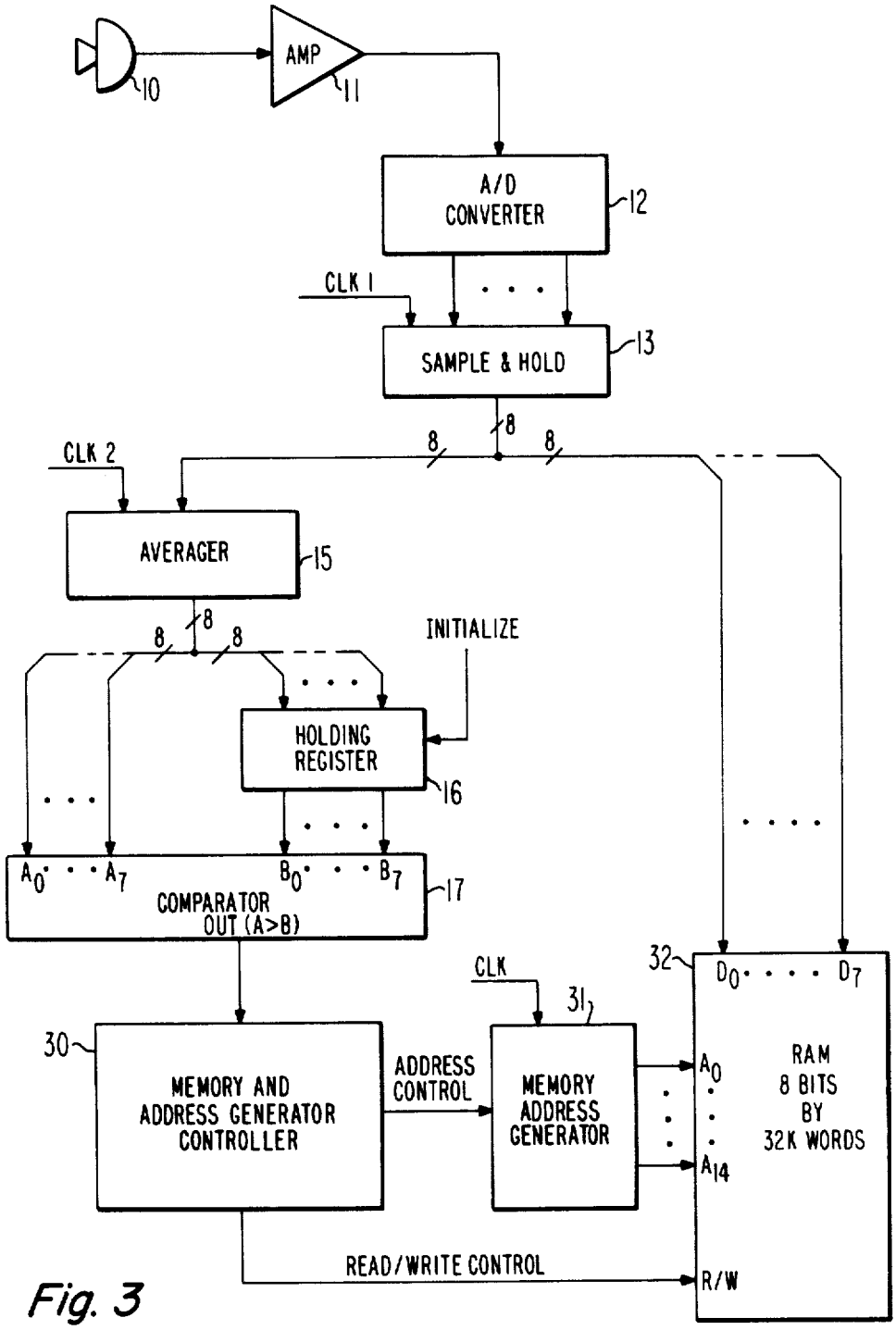
FIG. 3 illustrates, via a block diagram representation, an apparatus for detecting and storing spoken words according to a second embodiment of the present invention.

The embodiment illustrated in FIG. 3 is similar to the FIG. 2 embodiment with regard to the apparatus for receiving the speech/noise signal, converting it to digital data, sampling and averaging the data, and comparing it to a stored value. The major difference lies in the method of retaining the data received prior to the occurrence of detection of voiced speech. The FIG. 3 embodiment eliminates the need for shift register storage separate from the main RAM storage. It does this at the expense of more sophisticated control of the RAM and of its address generator.

Referring to FIG. 3, acoustic energy is received by microphone 10, which transforms it into an electrical signal which is amplified by amplifier 11 and converted into a number of digital signals (eight, in the present example) by A/D converter 12, which outputs are sampled by sample-and-hold circuit 13. The sampled data are applied to averaging circuit 15 which outputs are periodically compared by digital comparator 17 with the contents of holding register 16, which was previously loaded with data corresponding to an average background noise level.

The output data of sample-and-hold circuit 13 are also applied to the data (D) inputs of RAM 32. Memory address generator 31, under the control of memory address generator controller 30, determines the memory locations in which these data are to be stored. In addition, controller 30 controls the read and write functions of RAM 32. Controller 30 acts in response to the signal provided by comparator 17, which signal indicates the relation between the current average voice/noise level and the predetermined threshold level. The functions provided by controller 30 might well be incorporated within the operating program of the processor which additionally generates the INITIALIZE and other control signals, and which reads and analyzes the data stored in the memory.

Figure 4:
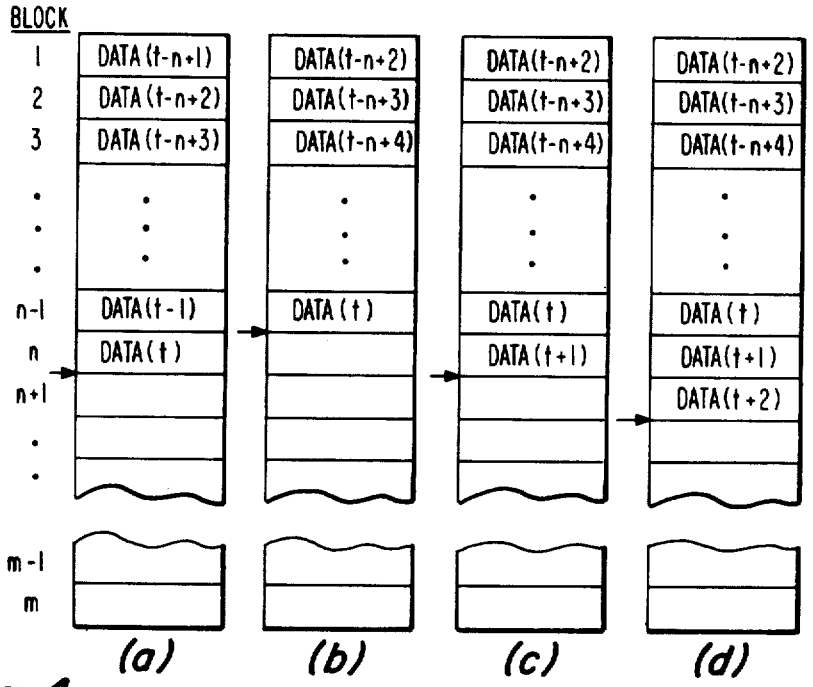
FIGS. 4(*a*) through 4(*d*) depict a memory map at four sequential stages, and are useful in explaining the operation of the apparatus of FIG. 3.

The operation of the apparatus of FIG. 3 can best be explained with reference to FIGS. 4(*a*) through 4(*d*), referred to collectively as FIG. 4, in which a typical sequence of memory data manipulation is shown, which sequence serves to illustrate the operation of the controller 30 by its effect on the data stored in memory. The four memory maps of FIG. 4 depict a progression of data and address pointer movement over a period of time proceeding from (a) to (d). Memory 32 is divided, as shown in the maps of FIG. 4, into a multiplicity of m contiguous blocks which are consecutively numbered 1, 2, 3, . . . n−1, n, n+1, . . . m−1 and m, where m is substantially greater than n. Each block comprises an equal number of individually addressable memory words which, in the present example, comprise eight bits. However, for the purposes of this disclosure, it is sufficient to deal with memory 32 in terms of its m blocks.

In the operation of this embodiment, a stream of digital data, representing samples of a speech signal, is transmitted from sampling circuit 13 to memory 32. At the outset, address generator 31 points at the first word of block n. The digital data are then stored in memory block n, by virtue of the progression of address generator 31 from the address of the first word of block n to the final word of block n. At this time digital comparator 17 is consulted to determine whether the average signal level of the latest block of data has sufficiently exceeded the threshold signal level as stored in holding register 16.

If the average level of this latest-received data block does not exceed the predetermined level, controller 30 causes the following two events:

(a) the data stored in the memory blocks ordinally numbered second through nth are transferred into corresponding storage locations in memory blocks ordinally numbered first through (n−1)st, respectively; and (b) the memory address generator is reset to cause it to address the initial storage location of the nth block.

If the average level of the latest-received data block does exceed the predetermined level, the address generator is permitted to sequentially address through memory 32 continuing from the first storage locations of the (n+1)st block. Data continues to be stored sequentially in this fashion until the entire memory has been loaded or until additional controlling means (not herein disclosed) indicates that the spoken information is complete. Thus, at the completion of the storage of spoken information, memory 32 will contain as many as m−n+1 blocks (data blocks n through m, inclusive) of speech signal received after the threshold signal level was first exceeded, and n−1 blocks (data blocks 1 through n−1, inclusive) of the speech signal which were received before the threshold signal level was exceeded.

Considering FIGS. 4(*a*) through 4(*d*) as an example, FIG. 4(*a*) represents a point in time at which data block n has just been filled with digital data received during time period t, and address generator 31, represented by an arrow positioned at the left of the memory map, has sequenced to the final address of data block n. Assuming that the average energy level of the data received during time period t did not exceed the predetermined threshold level as stored in holding register 16, the data stored in block 2 (which were received during time period (t−n+2)) are transferred into corresponding storage locations of block 1, the data stored in block 3 (which were received during time period (t−n+3)) are transferred into corresponding storage locations in block 2, and in like manner data are transferred from the other data blocks, up to and including data block n, into corresponding storage locations of the next preceding data block. The memory map of FIG. 4(*b*) depicts the contents of memory 32 following the above transfer operation.

FIG. 4(*c*) represents the point in time at which data block n has just been filled with digital data received during time period t+1, and address generator 31 has sequenced to the final address of data block n. Assume this time that the average energy level of the data received during time period t+1 did exceed the predetermined threshold level. For this condition there is no transfer of earlier data from block to block and no resetting of the address pointer. The next block of data, which is received during time period t+2, is loaded into block n+1, as shown in FIG. 4(*d*), and subsequent digital data which is received is loaded into successive blocks of memory 32 until memory 32 is filled up through block m, or until the operation is terminated by other means (not discussed herein).

A variation of the concept presented by the embodiment of FIGS. 3 and 4 would treat the memory addressing scheme as continuous, i.e., the last memory block would be considered adjacent to the first memory block. In this way, address generator 31 would cycle endlessly through the addresses of RAM 32, continuously storing the data corresponding to whatever acoustic signals were detected. At some time, when comparator 17 determined that a segment of voiced speech had been detected beginning at, for example, block n, then the contents of the preceding memory blocks, n−1, n−2, . . . , would be analyzed to determine if unvoiced speech had been present prior to detection of voiced speech.

In this variation, the cyclic nature of the addressing scheme causes current data to be written over previously detected data. For this reason, controller 30 must be cognizant of the output signal from comparator 17 and employ some criterion to determine when the voice source providing the received acoustic signal has been terminated. When this criterion has been met, controller 30 freezes the data in the storage locations of RAM 32 by disabling its write function until the contents of the memory blocks corresponding to voiced and unvoiced speech have been analyzed.

Other embodiments of the present invention will be apparent to those skilled in the art to which it pertains. The scope of this invention is not intended to be limited to the embodiments listed herein but should instead be gauged by the breadth of the claims which follow.

What is claimed is:

1. In a speech recognition system, an apparatus for storing speech parameters, said apparatus comprising:

transducer means responsive to acoustic energy for transforming said acoustic energy into analog electrical signals, wherein said acoustic energy comprises voiced speech, unvoiced speech and background noise;

signal processing means for converting said analog signals to substantially equivalent forms of speech parameters and for sampling said speech parameters at a predetermined sampling rate;

first storage means coupled to said signal processing means for temporarily storing a plurality of samples of said speech parameters from said signal processing means;

a binary adder coupled to said signal processing means for computing the average signal level of samples of said speech parameters from said signal processing means during predetermined periods of time;

a digital magnitude comparator coupled to said binary adder, said comparator generating a control signal when the computed average signal level exceeds a predetermined signal level, said predetermined signal level representative of said background noise;

second storage means coupled to said first storage means for storing speech parameters transferred from said first storage means; and means responsive to said control signal for conveying information stored in said first storage means to said second storage means, wherein said conveyed information includes speech parameters stored in said first storage means prior to the generation of said control signal.

2. The apparatus according to claim 1 wherein said first storage means is a shift register.

3. The apparatus according to claim 1 wherein said second storage means is a random access memory (RAM).

4. The apparatus according to claim 1 further including a register for storing said speech parameters, said register being coupled to said binary adder and to said digital magnitude comparator, wherein said speech parameters stored therein represent the average signal level computed by said binary adder in the absence of speech, and wherein said stored speech parameters establish said predetermined signal level.

5. The apparatus according to claim 1 wherein said transducer means includes a microphone.

6. In a speech recognition system, an apparatus for storing speech parameters, said apparatus comprising:

transducer means responsive to acoustic energy for transforming said acoustic energy into analog electric signals, wherein said acoustic energy comprises voiced speech, unvoiced speech and background noise;

signal processing means for converting said analog signals to substantially equivalent forms of speech parameters and for sampling said speech parameters at a predetermined sampling rate;

first storage means coupled to said signal processing means for temporarily storing a plurality of samples of said speech parameters from said signal processing means;

a binary adder coupled to said signal processing means for computing the average signal level of samples of said speech parameters from said signal processing means during predetermined periods of time;

second storage means coupled to said first storage means for receiving speech parameters transferred from said first storage means;

means coupled to said second storage means for generating sequential addresses corresponding to individual storage locations of said second storage means to permit storage of said transferred speech parameters therein; and means coupled to said address generating means and to said binary adder for resetting said generating means to a reference starting address when the average signal level computed during any of said predetermined periods of time fails to exceed a predetermined signal level.

7. The apparatus according to claim 6 wherein said first storage means is a shift register.

8. The apparatus according to claim 6 wherein said second storage means is a random access memory (RAM).

9. The apparatus according to claim 6 further including a register for storing digital data, wherein said data stored therein represent the average signal level computed by said binary adder in the absence of speech, and wherein said stored data establish said predetermined signal level.

10. The apparatus according to claim 6 wherein said address generator is a binary counter.

11. The apparatus according to claim 6 wherein said resetting means includes a digital magnitude comparator.

12. The apparatus according to claim 6 wherein said transducer means includes a microphone.

13. In a speech recognition system, an apparatus for storing speech parameters, said apparatus comprising:

transducer means responsive to acoustic energy for transforming said acoustic energy into analog electrical signals, wherein said acoustic energy comprises voiced speech, unvoiced speech and background noise;

signal processing means for converting said analog signals to substantially equivalent forms of speech parameters and for sampling said speech parameters at a predetermined sampling rate;

a binary adder coupled to said signal processing means for computing the average signal level of samples of said speech parameters from said signal processing means during predetermined periods of time;

storage means coupled to said signal processing means for receiving speech parameters, said storage means comprising a plurality of m contiguous blocks which are consecutively and ordinally numbered first through mth, each of said blocks comprising an equal number of storage locations, said number of storage locations corresponding to the number of samples of said speech parameters operated upon by said means for computing average signal level during each of said predetermined periods of time;

means coupled to said storage means for generating sequential addresses corresponding to individual storage locations of said storage means to permit storage of said speech parameters therein; and control means coupled to said storage means and said address generating means and responsive to said binary adder for:

(a) transferring speech parameters resident in the storage locations of the second through nth blocks of said storage means into corresponding storage locations of the first through (n−1)st blocks, respectively, of said storage means; and (b) resetting said generating means to thereby cause it to address the initial storage location of the nth block of said storage means; where n is a number substantially smaller than m;

when the average signal level computed by said binary adder during any of said predetermined periods of time fails to exceed a predetermined signal level.

14. The apparatus according to claim 13 wherein said storage means includes a random access memory (RAM).

15. The apparatus according to claim 13 further including a register for storing digital data, wherein said data stored therein represent the average signal level computed by said binary adder in the absence of speech, and wherein said stored data establish said predetermined signal level.

16. The apparatus according to claim 13 wherein said address generator is a binary counter.

17. The apparatus according to claim 13 wherein said control means includes a digital magnitude comparator.

18. The apparatus according to claim 13 wherein said transducer means includes a microphone.

* * * * *